US010655901B2

(12) United States Patent
Boarman et al.

(10) Patent No.: US 10,655,901 B2
(45) **Date of Patent: *May 19, 2020**

(54) REFRIGERATOR WITH ICE MOLD CHILLED BY FLUID EXCHANGE FROM THERMOELECTRIC DEVICE WITH COOLING FROM FRESH FOOD COMPARTMENT OF FREEZER COMPARTMENT

(71) Applicant: Whirlpool Corporation, Benton Harbor, MI (US)

(72) Inventors: Patrick Boarman, Evansville, IN (US); Brian Culley, Evansville, IN (US); Gregory Hortin, Henderson, KY (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/682,712

(22) Filed: Aug. 22, 2017

(65) Prior Publication Data

US 2017/0350634 A1 Dec. 7, 2017

Related U.S. Application Data

(63) Continuation of application No. 13/691,908, filed on Dec. 3, 2012, now Pat. No. 9,766,005.

(51) Int. Cl.
*F25C 1/00* (2006.01)
*F25D 17/06* (2006.01)
(Continued)

(52) U.S. Cl.
CPC ..... *F25C 1/00* (2013.01); *F25B 21/02* (2013.01); *F25C 5/22* (2018.01); *F25D 11/02* (2013.01);
(Continued)

(58) Field of Classification Search
CPC ..... F25D 11/02–027; F25D 17/065; F25B 21/02; F25B 21/04; F25B 2321/025; F25B 2321/0252; F25C 5/22
See application file for complete search history.

(56) References Cited

U.S. PATENT DOCUMENTS 2,513,823 A 7/1950 Shreve et al.
2,940,276 A 6/1960 Loewenthal et al.
(Continued)

FOREIGN PATENT DOCUMENTS

DE 102010001465 A1 8/2011
DE 102010042080 A1 4/2012
(Continued)

OTHER PUBLICATIONS

Uropean Patent Office, "European Search Report," issued in connection with European Patent Application No. 13182465.8, dated Dec. 2, 2016, 9 pages.
(Continued)

*Primary Examiner* — Keith M Raymond
(74) *Attorney, Agent, or Firm* — Nyemaster Goode, P.C.

(57) ABSTRACT

A refrigerator that has a fresh food compartment, a freezer compartment, and a door that provides access to the fresh food compartment is disclosed. An icemaker is mounted remotely from the freezer compartment. The icemaker includes an ice mold. A thermoelectric device is provided and includes a warm side and an opposite cold side. A fluid pathway is connected in communication between the cold side of the thermoelectric device and the icemaker. A pump moves fluid from the cold side of the thermoelectric device to the icemaker. Cold fluid or air may be taken from the freezer compartment to dissipate heat from the warm side of the thermoelectric device for providing cold fluid to and for cooling the ice mold or cool/warm fluid to other cooling or
(Continued)

warming applications in the refrigerator compartment or on the refrigerator compartment door.

16 Claims, 11 Drawing Sheets

(51) Int. Cl.
*F25D 11/02* (2006.01)
*F25B 21/02* (2006.01)
*F25C 5/20* (2018.01)

(52) U.S. Cl.
CPC ..... *F25D 17/065* (2013.01); *F25B 2321/025* (2013.01); *F25D 2323/021* (2013.01)

(56) References Cited

U.S. PATENT DOCUMENTS 3,111,813 A * 11/1963 Blumentritt ..... F25B 21/02 136/204
3,192,726 A 7/1965 Newton et al.
3,237,415 A 3/1966 Newton et al.
4,193,271 A 3/1980 Honigsbaum et al.
4,251,996 A 2/1981 Esformes et al.
4,448,032 A 5/1984 Hibino et al.
4,487,032 A 12/1984 Speicher et al.
5,032,157 A 7/1991 Ruff et al.
5,237,832 A 8/1993 Alston et al.
5,497,629 A 3/1996 Rafalovich et al.
5,505,046 A 4/1996 Nelson et al.
5,598,716 A 2/1997 Tanaka et al.
6,112,543 A 9/2000 Feuerecker et al.
6,293,107 B1 9/2001 Kitagawa et al.
6,327,871 B1 12/2001 Rafalovich
6,408,633 B1 6/2002 Carr
6,412,286 B1 7/2002 Park et al.
6,735,959 B1 * 5/2004 Najewicz ..... F25C 1/04 62/3.63
6,908,163 B1 6/2005 Hebeler et al.
6,945,068 B2 9/2005 Kim et al.
6,951,113 B1 10/2005 Adamski
7,089,756 B2 8/2006 Hu
7,093,458 B2 8/2006 Hu
7,269,960 B2 9/2007 Elsom et al.
7,278,269 B2 10/2007 Pham et al.
7,284,379 B2 10/2007 Pham et al.
7,310,953 B2 12/2007 Pham et al.
7,610,773 B2 * 11/2009 Rafalovich ..... F25C 1/24 62/356
7,681,406 B2 3/2010 Cushman et al.
7,752,852 B2 7/2010 Akei et al.
7,942,018 B2 5/2011 Niu et al.
8,042,355 B2 10/2011 Cur et al.
8,061,153 B2 11/2011 Cur et al.
8,099,975 B2 1/2012 Rafalovich et al.
8,240,159 B2 8/2012 Prabhakar et al.
2004/0012314 A1 1/2004 Hay et al.
2006/0168983 A1 8/2006 Tatsui et al.
2006/0260325 A1 11/2006 Lin
2006/0260350 A1 11/2006 Van Meter et al.
2006/0266059 A1 11/2006 Wetekamp et al.
2007/0051127 A1 3/2007 McMillin
2007/0101750 A1 * 5/2007 Pham ..... F25B 25/00 62/332
2008/0059003 A1 3/2008 Doberstein et al.
2008/0141699 A1 6/2008 Rafalovich et al.
2008/0155993 A1 7/2008 Kuehl
2008/0156007 A1 7/2008 Cur et al.
2008/0156009 A1 7/2008 Cur et al.
2008/0156028 A1 7/2008 Cur et al.
2008/0156030 A1 7/2008 Cur et al.
2008/0156031 A1 7/2008 Cur et al.
2008/0156032 A1 7/2008 Cur et al.
2008/0156033 A1 7/2008 Cur et al.
2008/0156034 A1 7/2008 Cur et al.
2009/0151375 A1 6/2009 Tarr et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0282844 A1 11/2009 Rafalovich et al.
2009/0302724 A1 12/2009 Allard et al.
2010/0071384 A1 3/2010 Lu et al.
2010/0115985 A1 5/2010 Mitchell et al.
2010/0126185 A1 5/2010 Cho et al.
2010/0138073 A1 6/2010 Tarr
2010/0147005 A1 6/2010 Watson et al.
2010/0147007 A1 6/2010 Froelicher et al.
2010/0147008 A1 6/2010 Watson et al.
2010/0154458 A1 6/2010 Davis et al.
2010/0242526 A1 9/2010 Junge et al.
2010/0326093 A1 12/2010 Watson et al.
2010/0326112 A1 12/2010 Prabhakar et al.
2011/0011119 A1 1/2011 Kuehl et al.
2011/0113810 A1 5/2011 Mitchell et al.
2011/0146335 A1 6/2011 Jung et al.
2011/0162829 A1 7/2011 Xiang
2011/0232888 A1 9/2011 Sasaki
2012/0031129 A9 2/2012 Tarr et al.
2012/0167596 A1 7/2012 Krause et al.

FOREIGN PATENT DOCUMENTS

EP 1517103 A2 3/2005
EP 1821051 A1 8/2007
EP 2322887 A2 5/2011
EP 2444761 A2 4/2012
JP 2000161835 A 6/2000
JP 2006084135 A 3/2006
KR 20110064738 A 6/2011

OTHER PUBLICATIONS

European Patent Office, "European Search Report," issued in connection with European Patent Application No. 13188928.9, dated Dec. 2, 2016, 8 pages.
European Patent Office, "European Search Report," issued in connection with European Patent Application No. 13188925.5, dated Dec. 14, 2016, 9 pages.
European Patent Office, "European Search Report," issued in connection with European Patent Application No. 13188923.0, dated Dec. 14, 2016, 12 pages.
European Patent Office, "European Search Report," issued in connection with European Patent Application No. 13188931.3, dated Dec. 2, 2015, 10 pages.
European Patent Office, "European Search Report," issued in connection with European Patent Application No. 13188943.8, dated Dec. 23, 2015, 9 pages.
European Patent Office, "European Search Report," issued in connection with European Patent Application No. 13188949.5, dated Dec. 2, 2015, 8 pages.
European Patent Office, "European Search Report," issued in connection with European Patent Application No. 13188938.8, dated Dec. 2, 2015, 8 pages.
European Patent Office, "European Search Report," issued in connection with European Patent Application No. 13188941.2, dated Dec. 2, 2015, 8 pages.
Vian, J. et al. "Development of a Termoelectric Ice Maker of Finders Incorporated into a Static Domestic Refrigerator", 5th European Conference on Thermoelectrics, Sep. 10, 2007, pp. 1-6.
Marlow, How Do Thermoelectric Coolers Work (TEC), retreived Jan. 2017 from http://www.marlow.com/resouces/general-faq/6-how-do-thermoelectric-coolers-tecs-work.html.

* cited by examiner

REFRIGERATOR WITH ICE MOLD CHILLED BY FLUID EXCHANGE FROM THERMOELECTRIC DEVICE WITH COOLING FROM FRESH FOOD COMPARTMENT OF FREEZER COMPARTMENT

CROSS-REFERENCE TO RELATED APPLICATION

This application is a continuation application of and claims priority to U.S. Ser. No. 13/691,908, filed on Dec. 3, 2012, entitled "REFRIGERATOR WITH ICE MOLD CHILLED BY FLUID EXCHANGE FROM THERMOELECTRIC DEVICE WITH COOLING FROM FRESH FOOD COMPARTMENT OR FREEZER COMPARTMENT," the disclosure of which is hereby incorporated herein by reference in tis entirety.

FIELD OF THE INVENTION

The invention relates generally to refrigerators with icemakers, and more particularly to refrigerators with the icemaker located remotely from the freezer compartment.

BACKGROUND OF THE INVENTION

Household refrigerators commonly include an icemaker to automatically make ice. The icemaker includes an ice mold for forming ice cubes from a supply of water. Heat is removed from the liquid water within the mold to form ice cubes. After the cubes are formed they are harvested from the ice mold. The harvested cubes are typically retained within a bin or other storage container. The storage bin may be operatively associated with an ice dispenser that allows a user to dispense ice from the refrigerator through a fresh food compartment door.

To remove heat from the water, it is common to cool the ice mold. Accordingly, the ice mold acts as a conduit for removing heat from the water in the ice mold. When the icemaker is located in the freezer compartment this is relatively simple, as the air surrounding the ice mold is sufficiently cold to remove heat and make ice. However, when the icemaker is located remotely from the freezer compartment, the removal of heat from the ice mold is more difficult.

Therefore, the proceeding disclosure provides improvements over existing designs.

SUMMARY OF THE INVENTION

According to one aspect, a refrigerator that has a fresh food compartment, a freezer compartment, and a door that provides access to the fresh food compartment is disclosed. An icemaker is mounted remotely from the freezer compartment. The icemaker includes an ice mold. A thermoelectric device includes a cold side and a warm side. A fluid supply pathway is in communication with cold side of the thermoelectric device and the icemaker and a flow pathway is in communication with the warm side of the thermoelectric device and the freezer compartment.

According to another aspect, a refrigerator that has a fresh food compartment, a freezer compartment, and a door that provides access to the fresh food compartment is disclosed. An icemaker is mounted remotely from the freezer compartment. The icemaker includes an ice mold. A thermoelectric device has a cold side and a warm side. A fluid supply pathway is connected in thermal communication between the cold side of the thermoelectric device and the icemaker and a flow pathway is connected in thermal communication between the warm side of the thermoelectric device and the freezer compartment.

According to another aspect, a method for cooling in a refrigerator that has a fresh food compartment, a freezer compartment, and a door that provides access to the fresh food compartment is disclosed. The method includes providing an icemaker mounted remotely from the freezer compartment. The icemaker includes an ice mold. A thermoelectric device is positioned having a cold side and a warm side. A fluid is moved from the cold side of the thermoelectric device to the icemaker and heat is moved through a flow pathway from the warm side of the thermoelectric device to the freezer compartment.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
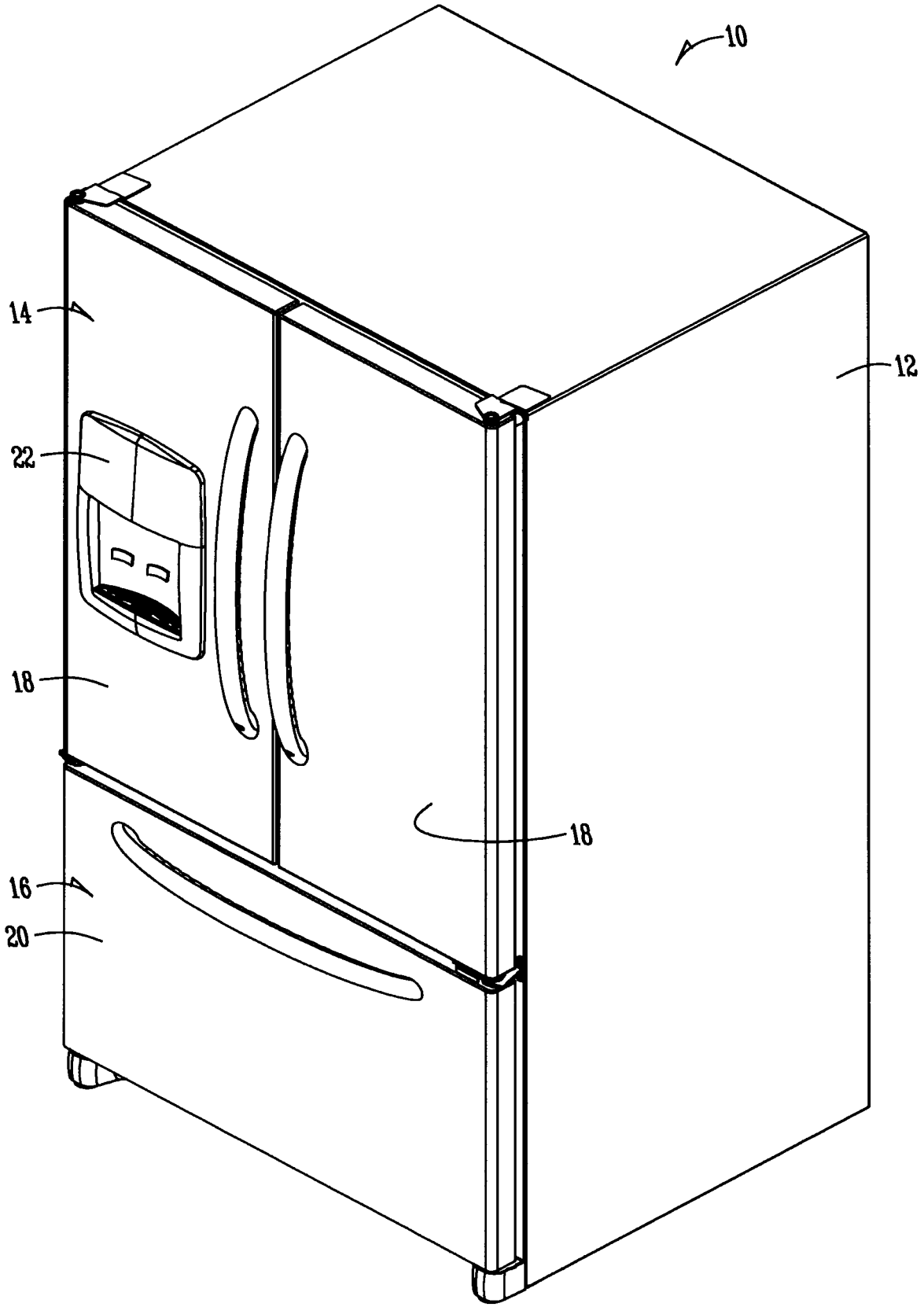
FIG. 1 is a perspective view illustrating exemplary aspects of a refrigerator.

Referring to the figures, there is generally disclosed in FIGS. 1-10 a refrigerator 10 configured to dispense ice from an icemaker 102 chilled by a thermoelectric device 50 cooled by fluid taken from the fresh food compartment or refrigerator compartment 14, where the fluid is chilled by a sub-zero freezer exchange in the refrigerator compartment 14 from the freezer compartment 16. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on a refrigerator compartment door 18 for providing dispensions of liquid and/or ice at the refrigerator compartment door 18. Although one particular design of a refrigerator 10 is shown in FIG. 1 and replicated throughout various figures of the disclosure, other styles and configurations for a refrigerator are contemplated. For example, the refrigerator 10 could be a side-by-side refrigerator, a traditional style refrigerator with the freezer compartment positioned above the refrigerator compartment (top-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14.

A common mechanism for removing heat from an icemaker 102, and thereby the water within the ice mold 106, is to provide cold air from the freezer compartment or freezer evaporator to the ice mold 106 by a ductwork or similar structure.

A refrigerator 10, such as illustrated in FIG. 1 may include a freezer compartment 16 for storing frozen foods, typically at temperatures near or below 0° Fahrenheit, and a fresh food section or refrigerated compartment 14 for storing fresh foods at temperatures generally between 38° Fahrenheit and about 42° Fahrenheit. It is common to include icemakers and ice dispensers in household refrigerators. In a side-by-side refrigerator, where the freezer compartment and the fresh food compartment are located side-by-side and divided by a vertical wall or mullion, the icemaker and ice storage bin are generally provided in the freezer compartment and the ice is dispensed through the freezer door. In recent years it has become popular to provide so-called bottom mount refrigerators wherein the freezer compartment is located below the fresh food compartment, at the bottom of the refrigerator. It is advantageous to provide ice dispensing through the refrigerated compartment door 18 so that the dispenser 22 is at a convenient height. In bottom mount refrigerators the icemaker and ice storage may be provided within a separate insulated compartment 108 located generally within or adjacent to, but insulated from, the fresh food compartment.

To remove heat from the water, it is common to cool the ice mold 106 specifically. Accordingly, the ice mold 106 acts as a conduit for removing heat from the water in the ice mold. As an alternative to bringing freezer air to the icemaker, a heat exchanger 50 comprising a thermoelectric device (TEC) 50 may be used to chill the ice mold 106. The thermoelectric device is a device that uses the Peltier effect to create a heat flux when an electric current is supplied at the junction of two different types of materials. The electrical current creates a component with a warm side and cold side. Thermoelectric devices are commercially available in a variety of shapes, sizes, and capacities. Thermoelectric devices are compact, relatively inexpensive, can be carefully calibrated, and can be reversed in polarity to act as heaters to melt the ice at the mold interface to facilitate ice harvesting. Generally, thermoelectric devices can be categorized by the temperature difference (or delta) between its warm side and cold side. In the ice making context this means that the warm side must be kept at a low enough temperature to permit the cold side to remove enough heat from the ice mold 106 to make ice at a desired rate. Therefore, the heat from the warm side of the thermoelectric device must be removed to maintain the cold side of the mold sufficiently cold to make ice. Removing enough heat to maintain the warm side of the thermoelectric device at a sufficiently cold temperature creates a challenge.

An additional challenge for refrigerators where the icemaker 102 is located remotely from the freezer compartment is the storage of ice after it is harvested. One way for retaining the ice in such situations is to provide an insulated compartment or bin 108 and to route the cold air used to chill the ice mold 106 to cool the ice.

Several aspects of the disclosure addressing the aforementioned challenges are illustrated in the sectional and cutout views of refrigerator 10.

In connection with the dispenser 22 in the cabinet body 12 of the refrigerator 10, such as for example on the refrigerator compartment door 18, is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or icemaker 102 may include a fluid sink 100 for extracting heat from the ice mold 106 using fluid as the extraction medium. Fluid for chilling the ice mold 106 may also be transferred from the freezer compartment 16 directly to the icemaker 102 or through the refrigerator compartment 14 to the icemaker 102 on the refrigerator compartment door 18. For example, a fluid sink 100 may be positioned in thermal contact with the ice mold 106 to remove heat from the ice mold 106. A fluid supply pathway 62 may be connected between the refrigerator compartment door 18 and the thermoelectric device 50 in the refrigerator compartment 14 for communicating chilled fluid from the thermoelectric device 50 to the icemaker 102 on the refrigerator compartment door 18. In another embodiment, chilled fluid (e.g., glycol or ethylene propylene) could be transferred from the freezer compartment 16 directly to the icemaker 102 or through the refrigerator compartment 14 to the icemaker 102 on the refrigerator compartment door 18.

Figure 2:
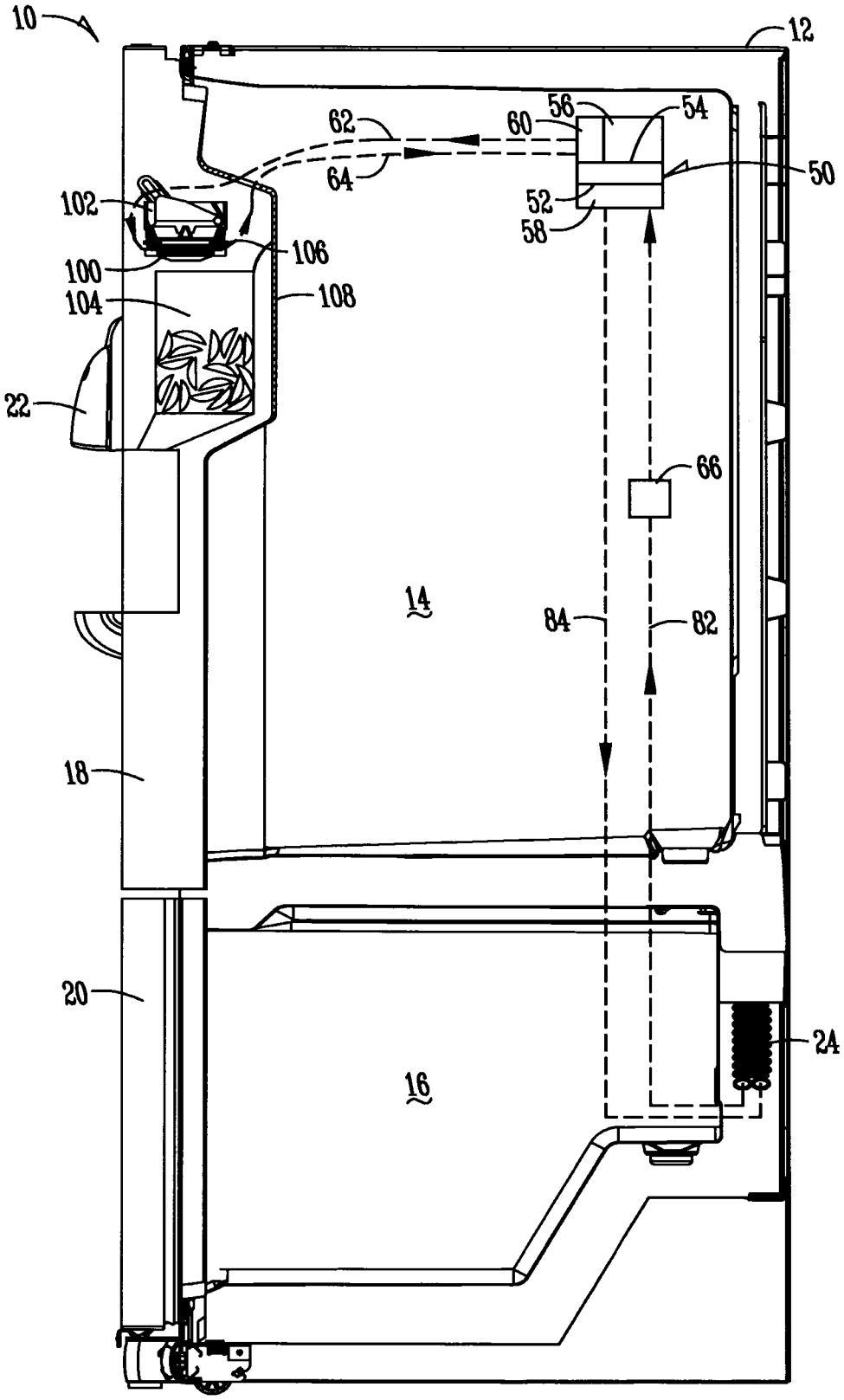
FIG. 2 is a side elevation view showing a sectional of an exemplary embodiment of the refrigerator illustrated in FIG. 1.

In FIG. 2 an elevation view showing a sectional of a refrigerator 10 is provided. The refrigerator 10 includes an icemaker 102 that may be included or positioned on the refrigerator compartment door 18. The icemaker 102 may be housed in an insulated compartment 108. Insulated compartment 108 provides a thermal barrier between the icemaker 102 and the ice storage bin 104 and the refrigerator compartment 14. The icemaker 102 includes an ice mold 106 and a fluid sink 100 in thermal contact with the ice mold 106 for producing ice which is harvested and dispensed into the ice storage bin 104. The icemaker 102 and ice storage bin 104 may be housed within an insulated compartment 108 for insulating the icemaker 102 and ice storage bin 104 from the refrigerator compartment 14. A thermoelectric device 50 may also be positioned at the icemaker 102 with its cold side 54 in thermal contact with the ice mold 106. Alternatively, a thermoelectric device 50 may be positioned within the refrigerator compartment 14 with its cold side 54 in thermal contact with a fluid sink 56 for communicating chilled fluid from the thermoelectric device 50 in the refrigerator compartment 14 to the refrigerator compartment door 18. Thus, a thermoelectric device 50 may be positioned in the refrigerator compartment 14 as shown, for example, in FIGS. 2 and 3 or on the refrigerator compartment door 18. There are advantages depending upon where in the refrigerator the thermoelectric device 50 is positioned. In the case where the thermoelectric device 50 is positioned in the refrigerator compartment 14 a fluid loop 62, 64 or fluid supply pathway 62 can be configured to carry chilled fluid (e.g., ethylene glycol) from the thermoelectric device 50 to the icemaker 102 on the refrigerator compartment door 18. For example, fluid is a more efficient carrier of heat (i.e., able to carry more heat per volume) than air so smaller tubing or hose (compared to an air duct), smaller and quitter pumps, and smaller volumetric flows are required to move the same amount of heat movable by air. Generally, the fluid carrying member (e.g., tube) is less likely to sweat or cause condensation to form. Fluid also has a higher thermal conductivity and is able to harvest heat from a fluid sink made from, for example, aluminum or zinc diecast faster than air even for smaller volumetric flows. Fluid pumps are also generally more efficient and quiet than air pumps that cost generally the same amount. Using a fluid like glycol or ethylene propylene also increases the above-described efficiencies, over for example, using air as the heat carrier. Another advantage of positioning the thermoelectric device 50 in the refrigerator compartment 14 is the ability to use a thermoelectric device with a larger footprint (compared to those that are used at the icemaker 102 or on the refrigerator compartment door 18). A thermoelectric device with a larger footprint generally has a greater heat transfer capacity (e.g., larger delta, heat transfer and volume rates). The thermoelectric device may have more capacity than is needed to chill the ice mold 106. The extra capacity can be used to chill water dispensed into the ice mold 106 to make ice, heat/chill fluid for warming or cooling another zone within the refrigerator or on one or more of the doors (e.g., warm/cool a bin, drawer or shelf). If the thermoelectric device 50 is adequately large and efficient, the refrigerator may be configured without a compressor. In such a design, the refrigerator could be configured with one or more thermoelectric devices for providing chilled fluid or air to specific zones within the refrigerator (e.g., chilled air or fluid transferred to any number of specific bins, compartments, locations, or shelves).

Figure 3:
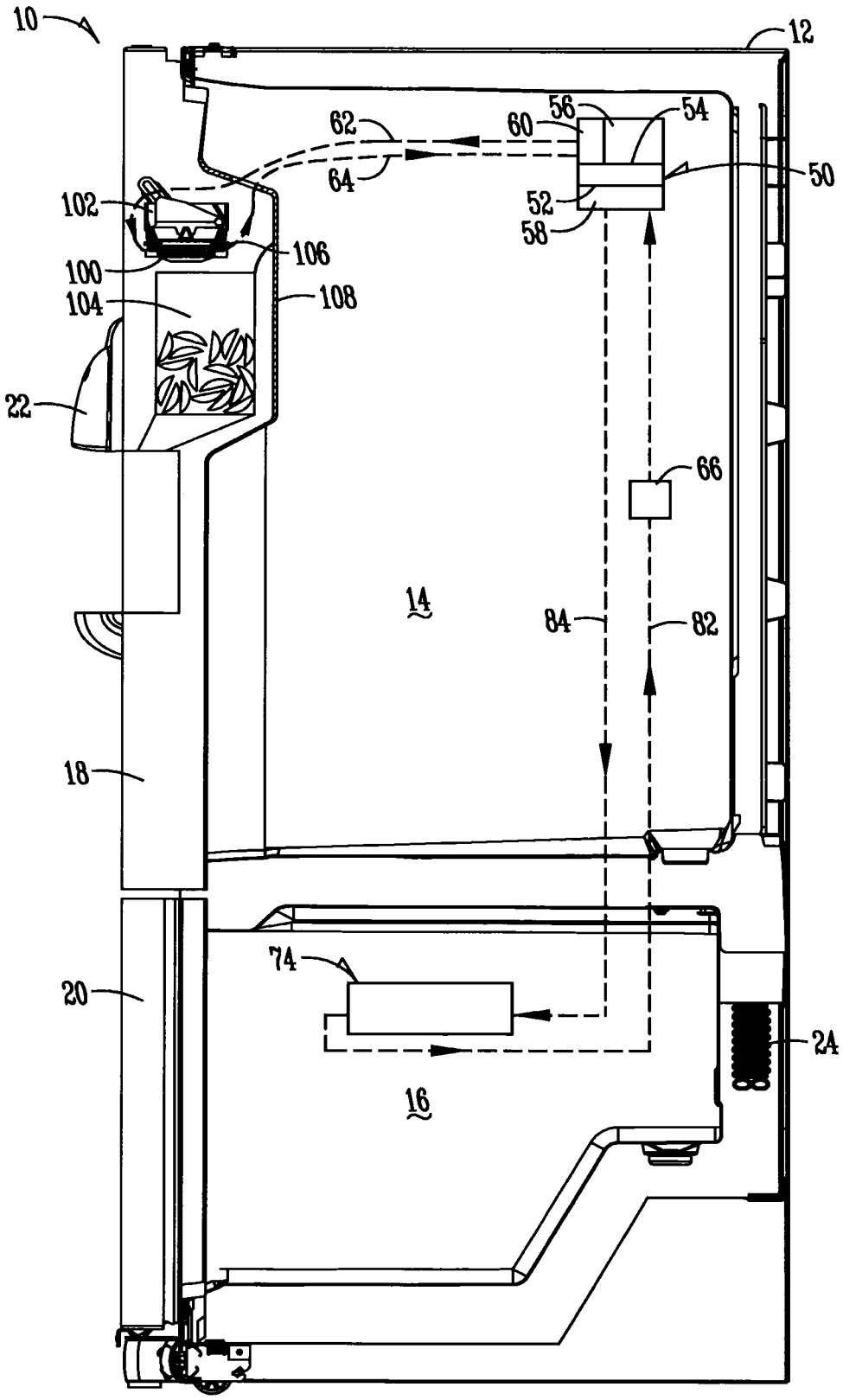
FIG. 3 is a side elevation view showing a sectional of another exemplary embodiment of the refrigerator illustrated in FIG. 1.
Figure 6:
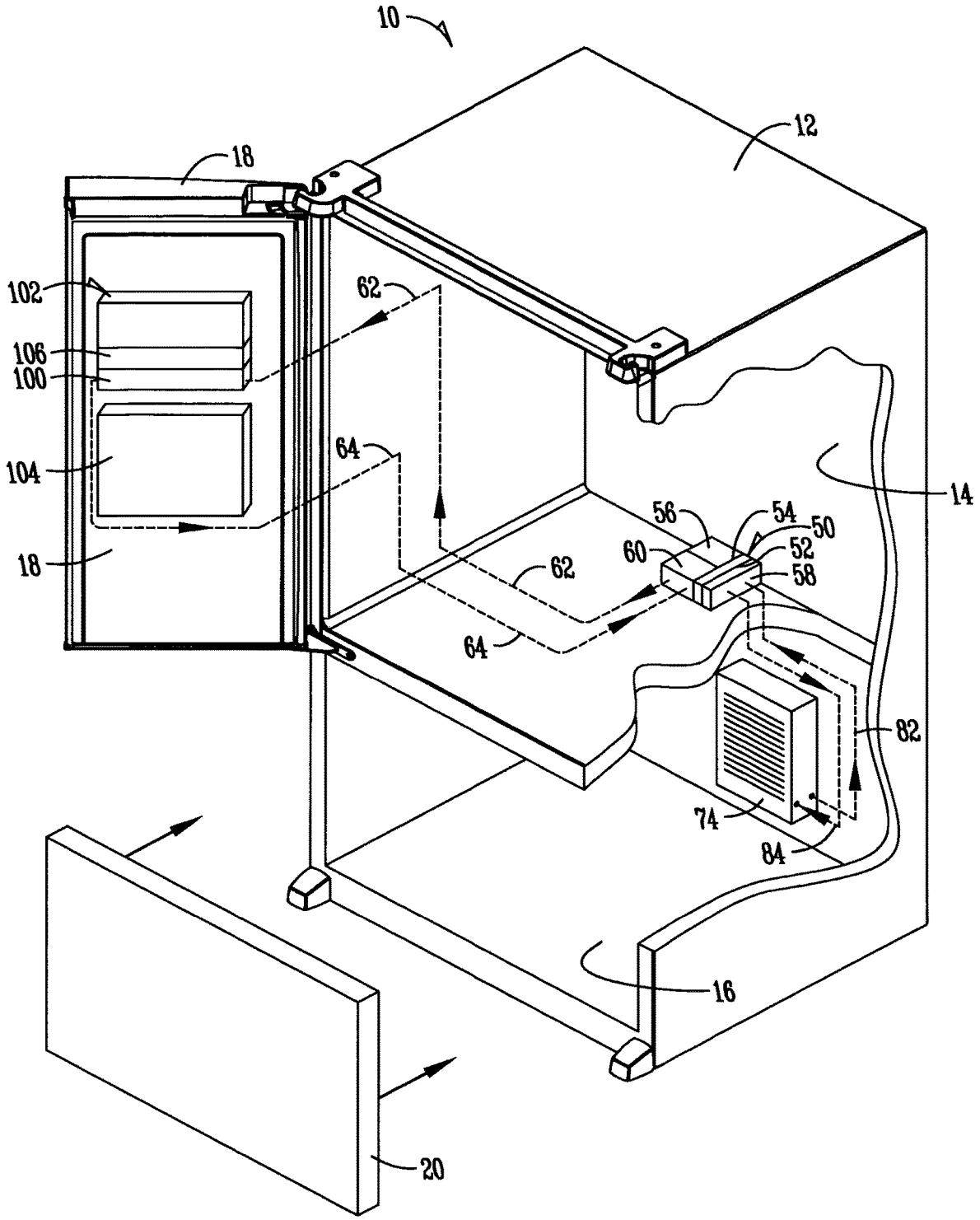
FIG. 6 is a perspective view showing a cutout illustrating an exemplary configuration of the refrigerator.

In the case where fluid is used as the heat carrying medium, a fluid supply pathway 62 may be connected between the fluid sink 56 and the icemaker 102 in the insulated compartment 108 on the refrigerator compartment door 18. As shown for example in FIGS. 2 and 3, a pump 60 may be configured to move fluid from the fluid sink 56 in thermal contact with the cold side 54 of the thermoelectric device 50 through the fluid supply pathway 62 to the icemaker 102. The chilled fluid in the pathway 62 is communicated through the fluid sink 100 in thermal contact with the ice mold 106. In another aspect, fluid may be communicated through cooling channels or veins in the ice mold 106. Heat coming off the warm side 52 of the thermal electric device 50 may be extracted using chilled or sub-zero fluid (e.g., glycol) from the freezer compartment 16. For example, in one aspect of the refrigerator 10, a fluid supply pathway 82 may be connected between an evaporator 24 (or a secondary evaporator) and a fluid sink 58 in thermal contact with the warm side 52 of the thermal electric device 50. A fluid return pathway 84 may be connected between the evaporator 24 (or a secondary evaporator) and the fluid sink 58 in thermal contact with the warm side 52 of the thermal electric device 50. The fluid supply pathway 82 and the fluid return pathway 84 may be configured as a fluid loop between the evaporator 24 and the fluid sink 58 for extracting heat off of the warm side 52 of the thermal electric device 50. A pump 66 may be configured in the fluid loop for moving a cooling fluid (e.g., ethylene glycol or ethylene propylene) from the evaporator to and from the evaporator 24 between the fluid sink 58. Alternatively, as illustrated in FIGS. 3 and 6, a cold battery or cold reservoir of cooling fluid may be positioned within the refrigerator compartment 14. In one aspect of the refrigerator 10, a heat exchanger 74 is positioned within the freezer compartment 16. The heat exchanger 74 may also include a fluid reservoir of fluid such as ethylene glycol or ethylene propylene to increase its cold storage potential. The heat exchanger 74 may also comprise a cold battery having a fluid reservoir and the potential of storing a fluid such as ethylene glycol or ethylene propylene at a temperature at or below freezing. Similar to the configuration using the evaporator 24 shown in FIG. 2, the heat exchanger 74 may be connected to the fluid sink 58 by a fluid supply pathway 82 and a fluid return pathway 84. The fluid supply pathway 82 and the fluid return pathway 84 may be configured as a loop for moving fluid from the heat exchanger 74 to the fluid sink 58. A pump 66 may be configured to move fluid through the fluid supply pathway 82 and fluid return pathway 84 between the fluid sink 58 and the heat exchanger 74 positioned in the freezer compartment 16. The fluid in the loop is chilled to the temperature of the freezer compartment and used to extract heat off of the warm side 52 of the thermoelectric device 50 which is then returned to the heat exchanger 74 positioned in the freezer compartment 16. For example, if the freezer compartment is set at 20° Fahrenheit, the warm side 52 of the thermoelectric device 50 may be kept at or near 20° Fahrenheit. The cold side 54 of the thermoelectric device 50 may be then kept at 20° Fahrenheit minus the delta of the thermoelectric device 50. For example, if the thermoelectric device has a delta of 20°, the cold side 54 may be kept at a temperature of 0° Fahrenheit. The fluid from the fluid sink 56 is then cooled to at or near 0° Fahrenheit or the temperature of the cold side 54 of the thermoelectric device 50. The pump 60 moves the chilled fluid from the fluid sink 56 to the icemaker 102 through the fluid supply pathway 62 as previously indicated. The chilled fluid (e.g., glycol) passes through a fluid sink 100 in thermal contact with the ice mold 106 for extracting heat from the ice mold 106 for making ice. The fluid passes through the fluid sink 100 in thermal contact with the ice mold 106 through a fluid return pathway 64.

A thermoelectric device 50 may also be positioned with its cold side 54 in thermal contact with the ice mold 106. A fluid sink may be connected in thermal contact with the warm side 52 of the thermal electric device 50. A fluid pathway may be configured between the fluid sink in thermal contact with the warm side of the thermoelectric device and a thermal exchanger positioned within the refrigerator compartment 14. Cold fluid from a heat exchanger, such as heat exchanger 74 positioned in the freezer compartment 16 or an evaporator 23 may be communicated to the heat exchanger in the refrigerator compartment 14 for pulling heat away from the heat exchanger. The sub-zero cooling potential communicated to the heat exchanger from the freezer compartment 16 may be carried by fluid to a thermoelectric device connected in thermal contact with the ice mold 106 of the icemaker 102 in the refrigerator compartment door 18. For example, a fluid loop may be configured to communicate cooling fluid from a thermal exchanger in the refrigerator compartment 14 to the ice mold 102. Alternatively, an air loop may be configured to communicate cool air from the heat exchanger in the refrigerator compartment 14 to the ice mold 106. A thermoelectric device having a cold side 54 in thermal contact with the ice mold 106 may be cooled by fluid or air taken from a heat exchanger within the refrigerator compartment 14 where the exchange is provided by a cooling loop connected between a heat exchanger 74 or an evaporator 24 in the freezer compartment 16.

Figure 8:
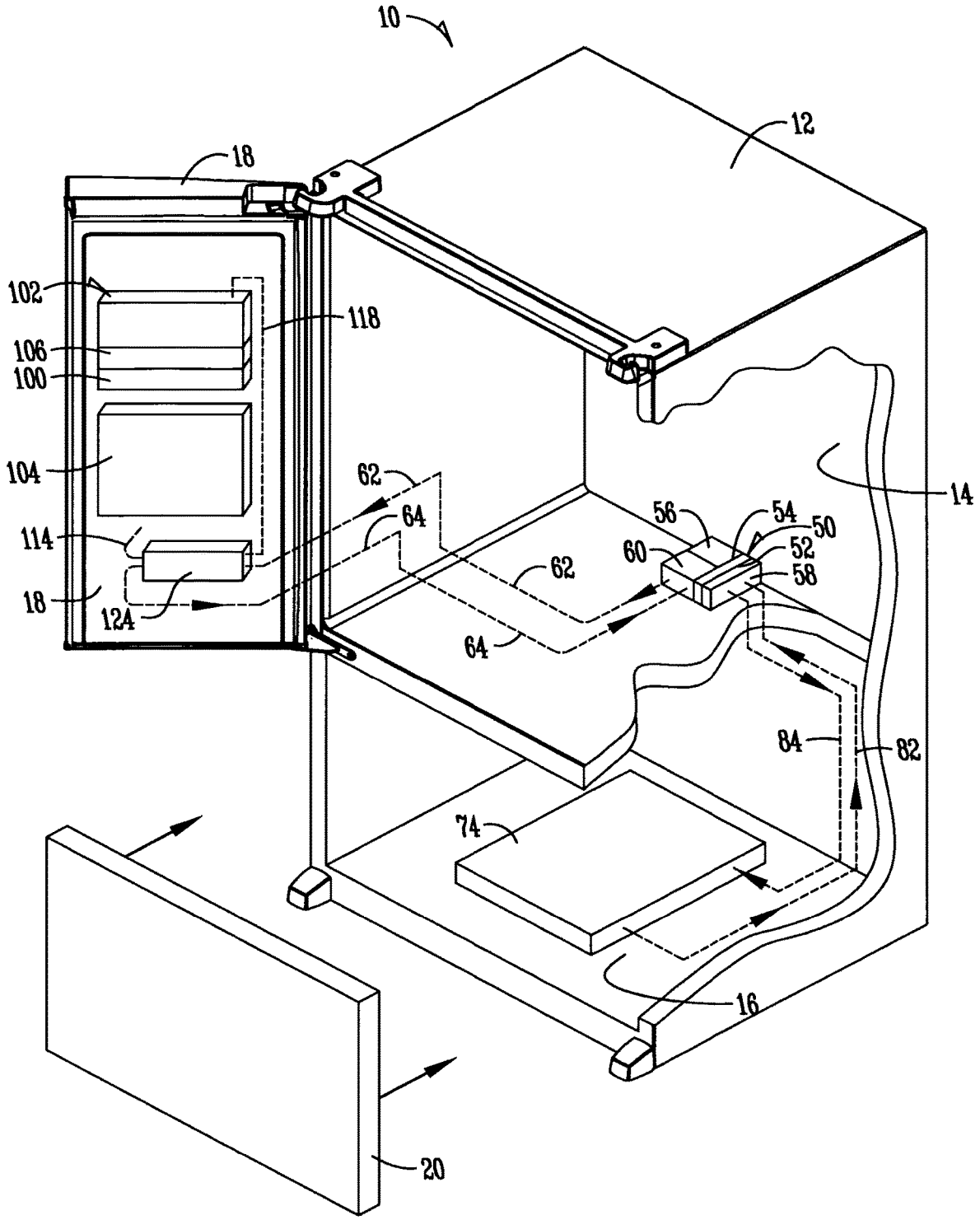
FIG. 8 is a perspective view with a cutout for illustrating another exemplary configuration of the refrigerator.

In each of the above aspects, fluid from the freezer compartment 16 may be communicated directly to a cooling application on the refrigerator compartment door 18 (e.g., chilling the ice mold 106, chilling a reservoir of water for dispensing at dispenser 22 or for filling the ice mold 106, chilling the ice storage bin 104, etc.). For example, FIG. 8 illustrates an exemplary configuration for a refrigerator 10 where the chilled fluid from the thermoelectric device 50 is communicated to a cooling application 124. Water in a reservoir in the cooling application 124 is chilled to or near the temperature of the chilled fluid from the thermoelectric device 50. The water may then be communicated through a fluid supply pathway 114 to the dispenser 22 for supplying cold water to drink or through a fluid supply pathway 118 to the ice mold 106 for supply prechilled water to the ice mold 106 for making ice. The configuration illustrated in FIG. 8 may also be used to provide a heating application on the refrigerator compartment door 18 or within the refrigerator compartment 14. By reversing the polarity of the thermoelectric device 50 the fluid in the supply pathway 62 may be heated and used at the application 124 for heating a reservoir of water. The warm reservoir of water may be used to provide warm water at the dispenser 22 or warm water at the icemaker 102 via supply pathway 114 and supply pathway 118, respectively. The warm water at the dispenser may be used for warm liquid drinks and the warm water at the icemaker 102 may be used to purge the ice mold 106.

Figure 4:
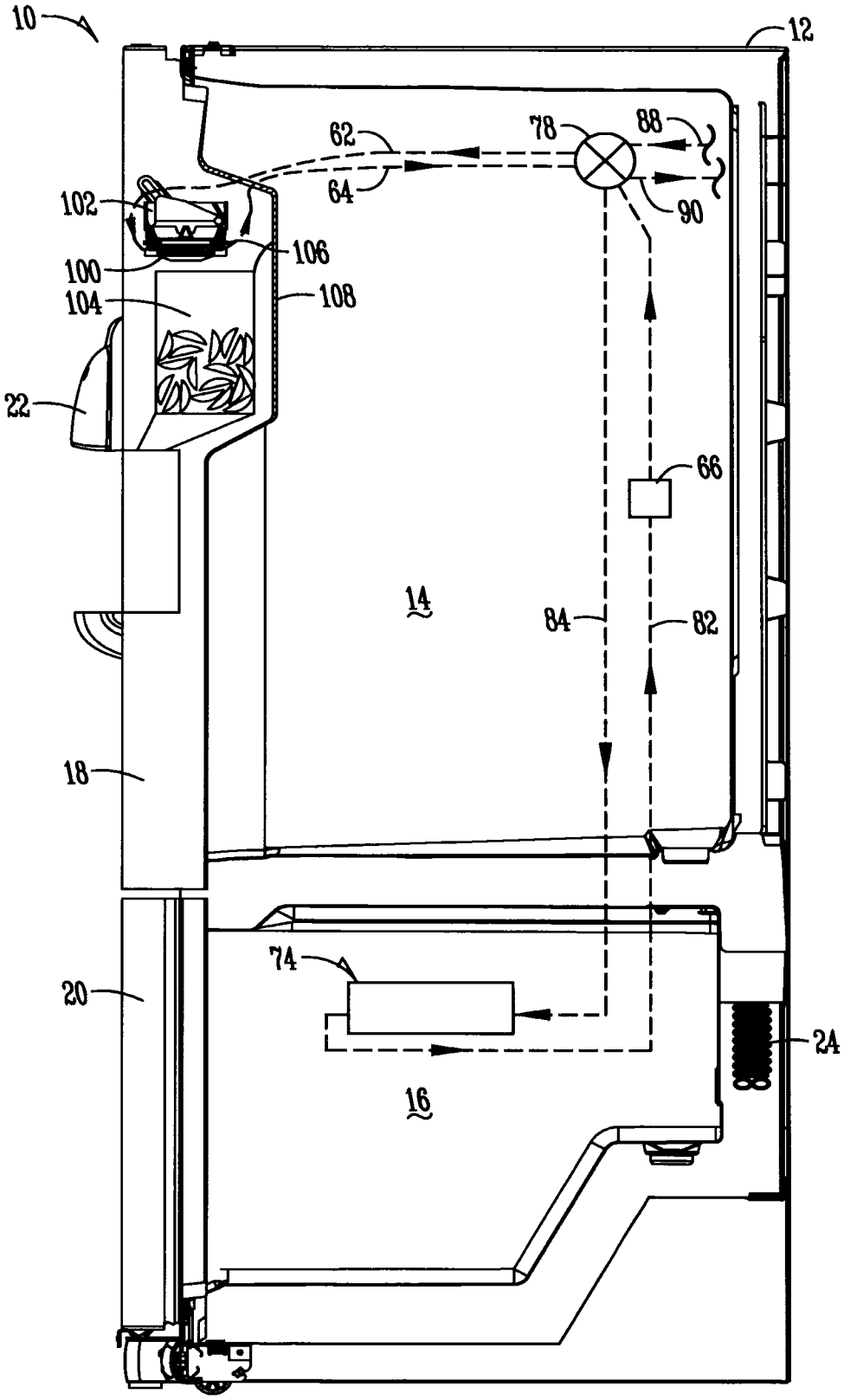
FIG. 4 is a side elevation view showing a sectional of another exemplary embodiment of the refrigerator illustrated in FIG. 1.

In general, fluid may be communicated through the refrigerator compartment 14 (e.g., through a heat exchanger, thermoelectric device, flow controller, etc.) partially or in full. Some fluid may be diverted directly, or at least partially, to chilling applications on the door 18 or to chilling applications in the refrigerator compartment 14. For example, as illustrated in FIG. 4, sub-zero or at least nearly freezing fluid may be communicated from the freezer compartment 16 (e.g., from the heat exchanger 74 or evaporator 24) to a flow controller 78 (e.g., a fluid distributor) in the refrigerator compartment 14. By way of a fluid supply pathway 82 and fluid return pathway 84, fluid may communicated between the flow controller 78 and the freezer compartment 16. A pump 66 may be configured into the fluid loop to move fluid to and from the flow controller 78. The flow controller 78 may be configured to communicate chilled fluid to one or more cooling applications in the refrigerator compartment 14 or on the refrigerator compartment door 18. For example, a fluid supply pathway 62 may be connected between the flow controller 78 and the icemaker 102 for chilling the ice mold 106. The flow controller 79 may be operated to communicate a certain volumetric flow of chilled fluid to the icemaker 102 depending upon the desired rate of ice production. The chilling fluid may be returned to the flow controller 78 and/or to the freezer compartment (e.g., heat exchanger 74 or evaporator) through, for example, a return fluid pathway 64. Another fluid supply pathway 88 and return pathway 90 may be configured to communicate chilled fluid to an application in the refrigerator compartment 14 for chilling a bin, shelf, compartment, or other defined space either in the refrigerator compartment 14 or on the refrigerator compartment door 18.

Figure 5:
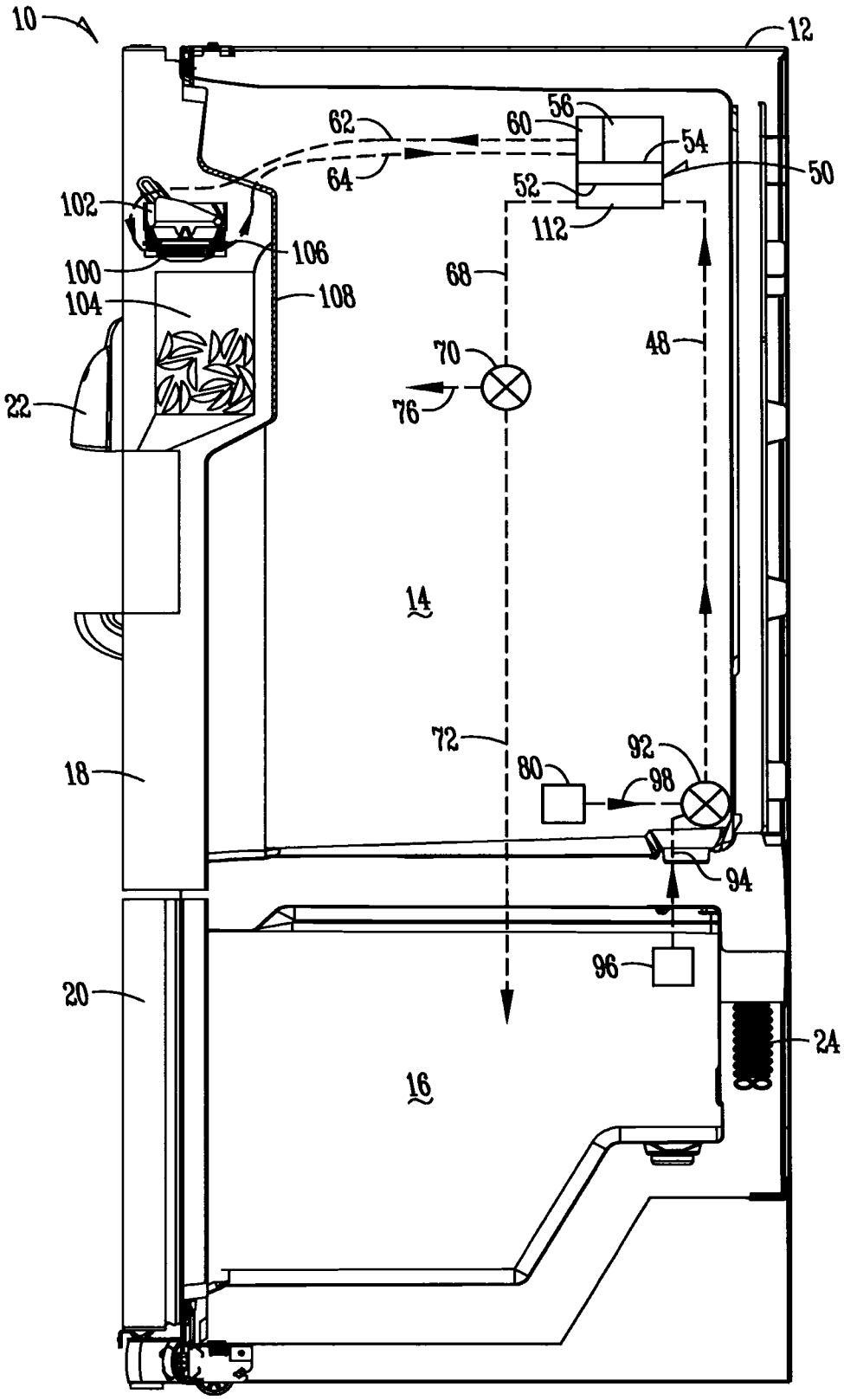
FIG. 5 is a side elevation view showing a sectional of another exemplary embodiment of the refrigerator illustrated in FIG. 1.
Figure 7:
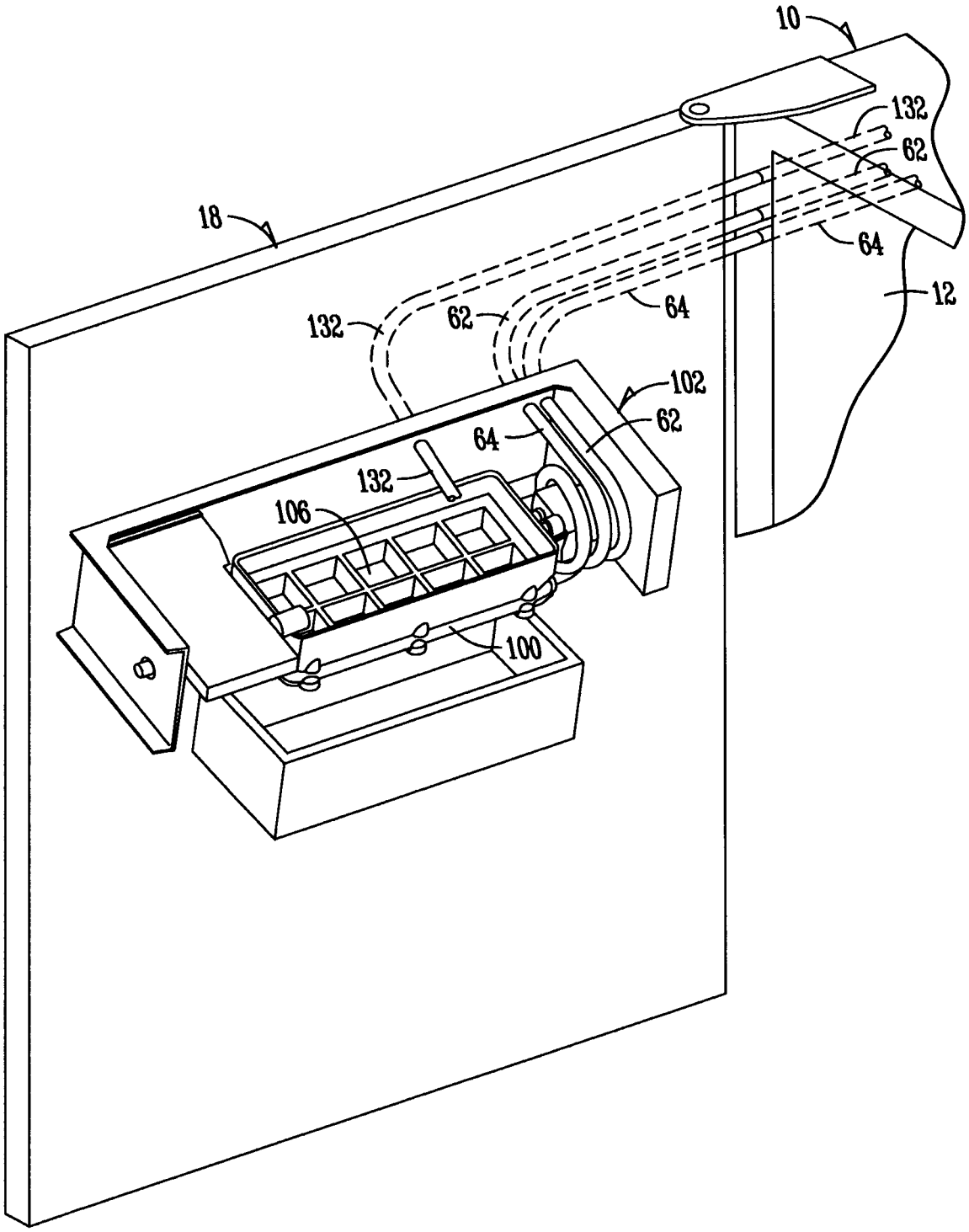
FIG. 7 is a perspective view of an exemplary configuration for the inside of a refrigerator compartment door.

As is illustrated in FIG. 5, a refrigerator 10 may be configured with a thermoelectric device 50 positioned within the refrigerator compartment 14. The thermoelectric device 50 includes a warm side 52 and a cold side 54. The warm side 52 is in thermal contact with an air sink 112. Sub-zero or near sub-zero air may be communicated through an air supply pathway 48 from the freezer compartment 16 to the air sink 112 in thermal contact with the warm side 52 of the thermoelectric device 50 in the refrigerator compartment 14. For example, a fan 96 may be configured to communicate air from the freezer compartment 16 through an air supply pathway 94 to a flow controller 92 configured to distribute air through the air supply pathway 48. Air may also be communicated to the air sink 112 through the air supply pathway 48 from the refrigerator compartment 14. For example, air may be communicated by a fan 80 through an air supply pathway 98 to the flow controller 92, which may be configured to distribute air through the air supply pathway 48. The flow controller 92 may also be configured to take air from the refrigerator compartment 14 and the freezer compartment 16 simultaneously. The flow controller 92 may also be configured to select a flow distribution when pulling air from both compartments 14, 16. The fans 80 and 96 may also be controlled to change the rate at which air is communicated from one or both compartments 14, 16. A flow controller 70 may also be configured in the air return flowpath 68 to distribute air into the refrigerator compartment via air return pathway 76 and/or into the freezer compartment 16 via air return pathway 72 depending upon where in the refrigerator 10 is best suited for receiving the exhausted air. To communicate chilled fluid to the icemaker 102, a fluid sink 56 is configured in thermal contact with the cold side 54 of the thermoelectric device 50. A pump 60 may be operably arranged to move fluid from the cold side 54 of thermoelectric device 50 through the fluid sink 56. The chilled fluid is passed through a fluid supply pathway 62 passing through the refrigerator compartment to the refrigerator compartment door 18. The fluid supply pathway 62 and air supply pathway 48 may be configured in a duct in a sidewall, a mullion or separate enclosure within the cabinet body defining the refrigerator compartment 14. A flexible conduit or other carrier may be configured between the cabinet and the door to allow fluid to be moved from the refrigerator compartment to the refrigerator compartment door 18. A fluid sink 100 is connected in thermal contact with the ice mold 106 of the icemaker 102. Chilled fluid passing through the fluid supply pathway 62 as illustrated in FIG. 7 extracts heat from the ice mold 106, which freezes the water in the ice mold 106. A separate fluid return pathway 64 may also be configured with a junction across the door between the door and the cabinet to transfer return fluid from the ice mold 105 to the fluid sink 56 in thermal contact with the cold side 54 of the thermoelectric device 50 in the refrigerator compartment. As previously indicated, the thermoelectric device 50 may be positioned on the door at the icemaker 102 so that the cold side 54 is in thermal contact with the ice mold and the warm side 52 is in thermal contact with a fluid sink. Chilled fluid from a heat exchanger 74 or evaporator 24 positioned within the freezer compartment 16 may be used to chill the fluid sink in thermal contact with the ice mold 106. In the case where the thermoelectric device 50 is positioned on the refrigerator compartment door 18 and chilled by a fluid exchange from the freezer compartment 16, a fluid loop or fluid supply pathway may be configured between the ice mold 106 and the thermoelectric device 50. In another exemplary aspect of the refrigerator shown in FIG. 5, the fluid supply pathway 62 may be configured to provide chilled fluid to the ice storage bin 104 for chilling the bin. The ice storage bin 104 temperature may be controlled by controlling the temperature of the chilled fluid received from the thermoelectric device 50. Thus, fresh ice or wet ice may be provided by keeping the bin 104 temperature just above freezing. A series of serpentine coils, channels or ducts may be configured into the bin 104 to extract heat from the bin 104 for chilling the ice and carry the heat back to the thermoelectric device 50 through the fluid return pathway 64.

Figure 9:
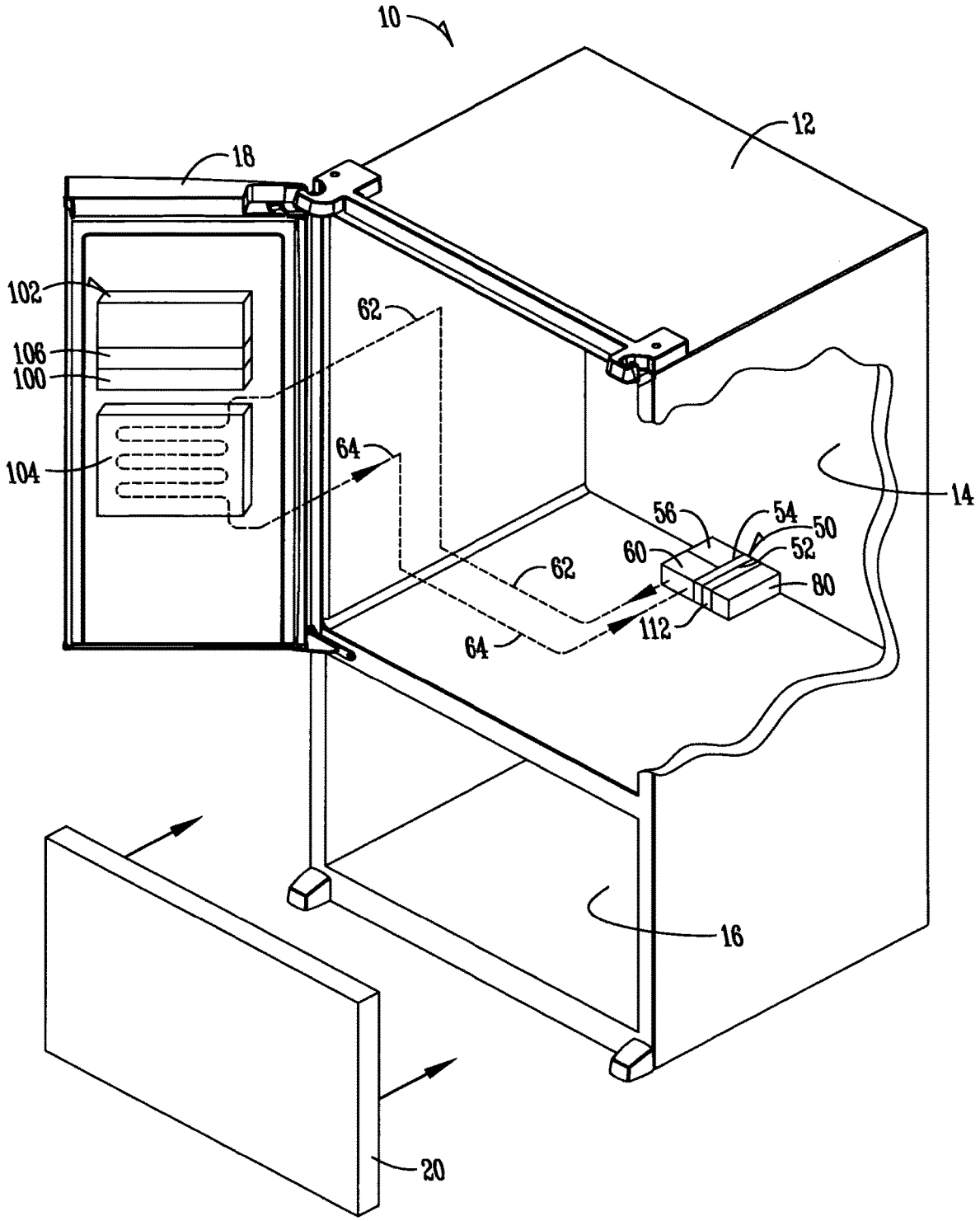
FIG. 9 is perspective view with a cutout for illustrating other exemplary configurations of the refrigerator.

In another aspect of the refrigerator 10, as illustrated in FIG. 9, the ice storage bin 104 may be chilled or warmed using the exchange process previously described. For example, a thermoelectric device 50 may be positioned within the refrigerator compartment 14 or on the refrigerator compartment door 18. A fluid supply pathway 62 may be connected to the thermoelectric exchange for supplying cold or warm fluid to the ice storage bin 104 on the refrigerator compartment door 18. The fluid in the supply pathway 62 may be used to heat or cool the ice storage bin 104. For example, cold fluid pulled from off the cold side 54 of the thermoelectric device 50 may be used to chill the ice storage bin 104 in addition to extracting heat off of the fluid sink 100 in thermal contact with the ice mold 106. A flow controller may be configured to control the flow of cold fluid to the fluid sink 100 and the ice storage bin 104 to support the desired rate of ice production and the desired temperature of the ice storage bin 104. In one aspect of the invention, sub-zero fluid is communicated from the thermoelectric device 50 through the fluid supply pathway 62 to the ice storage bin 104 for keeping the ice in the bin at freezing temperatures. Liquid may also be used to harvest heat from the ice mold 106 and from the ice storage bin 104 for chilling both. By reversing the polarity of the thermoelectric device, warm fluid may be communicated through the supply pathway 62 to warm the ice storage bin 104 for creating fresh ice and cold ice melt drained from the ice storage bin 104 through a drain (not shown). The warm air fluid may also be communicated from the thermoelectric exchange to the icemaker 102 for ice harvesting. For example, warm fluid may be used to warm the ice mold 106 or warm fluid may be used to warm the fluid sink 100 for warming ice mold 106 during the ice harvesting process. As previously indicated, the thermoelectric device 50 may be positioned on the refrigerator compartment door 18 or within the refrigerator compartment 14. A heat exchanger (e.g., such as thermoelectric device 50) may be configured between the door 18 and the cabinet 12 to allow the transfer of cold fluid from the heat exchanger in the refrigerator compartment to the thermoelectric device on the refrigerator compartment door 18. Sub-zero fluid taken from the freezer compartment or evaporator may be used to chill the heat exchanger in the refrigerator compartment for providing cold liquid to a cooling application on the door as previously indicated. Alternatively, warm air may be provided to a warming application on the door 18 or within the refrigerator compartment 14 by reversing the polarity of the thermoelectric device 50.

Figure 10:
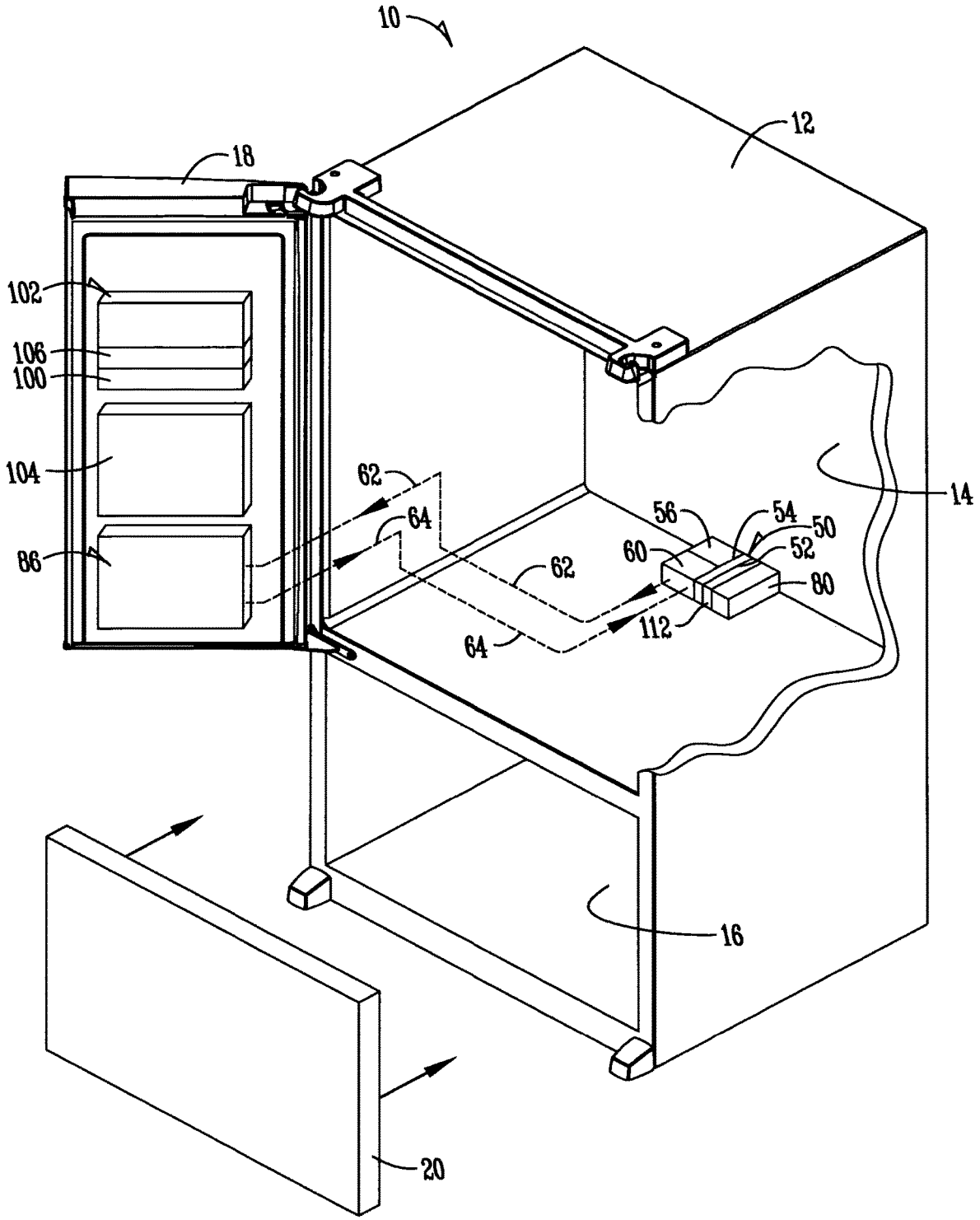
FIG. 10 is perspective view with a cutout for illustrating another exemplary embodiment for the refrigerator.

According to another aspect of the refrigerator 10 illustrated in FIG. 10, a cooling application 86 may also be provided on the refrigerator compartment door 18. For example, a module, cabinet, drawer, isolated space (insulated from the refrigerator compartment) may be configured at the refrigerator compartment door 18 or within the refrigerator compartment 14. The fluid supply pathway 62 may be connected between the thermoelectric device 50 and the sub-zero application 86 for providing chilled liquid to the application through the thermoelectric exchange process 50. In another aspect, sub-zero or near sub-zero fluid may be taken from the freezer compartment 16 or evaporator 24 to pull heat off the warm side 52 of the thermoelectric device 50. Alternatively, the thermoelectric device 50 may be operated in reverse polarity to provide a warming application within at the refrigerator compartment door 18 or within the refrigerator compartment 14. For example, an isolated drawer, cabinet, module or other enclosure insulated or non-insulated may be configured at the refrigerator compartment door 18 or within the refrigerator compartment 14 to receive warm fluid from the thermoelectric device 50 housed within the refrigerator compartment 14. A pathway 62 for providing warm or cold fluid to the application 86 may be configured between the application and the thermoelectric device 50. A return pathway 64 may also be configured between the application 86 and the thermoelectric device 50. A flow controller (not shown) may be configured within the supply or return pathway 62 or 64 for distributing chilled fluid to other cooling/warming applications within the refrigerator compartment 14 or on the door 18. The supply pathway 62 and return pathway 64 may be configured as a fluid loop between the thermoelectric device 50 and the cooling/warming application 86.

Figure 11:
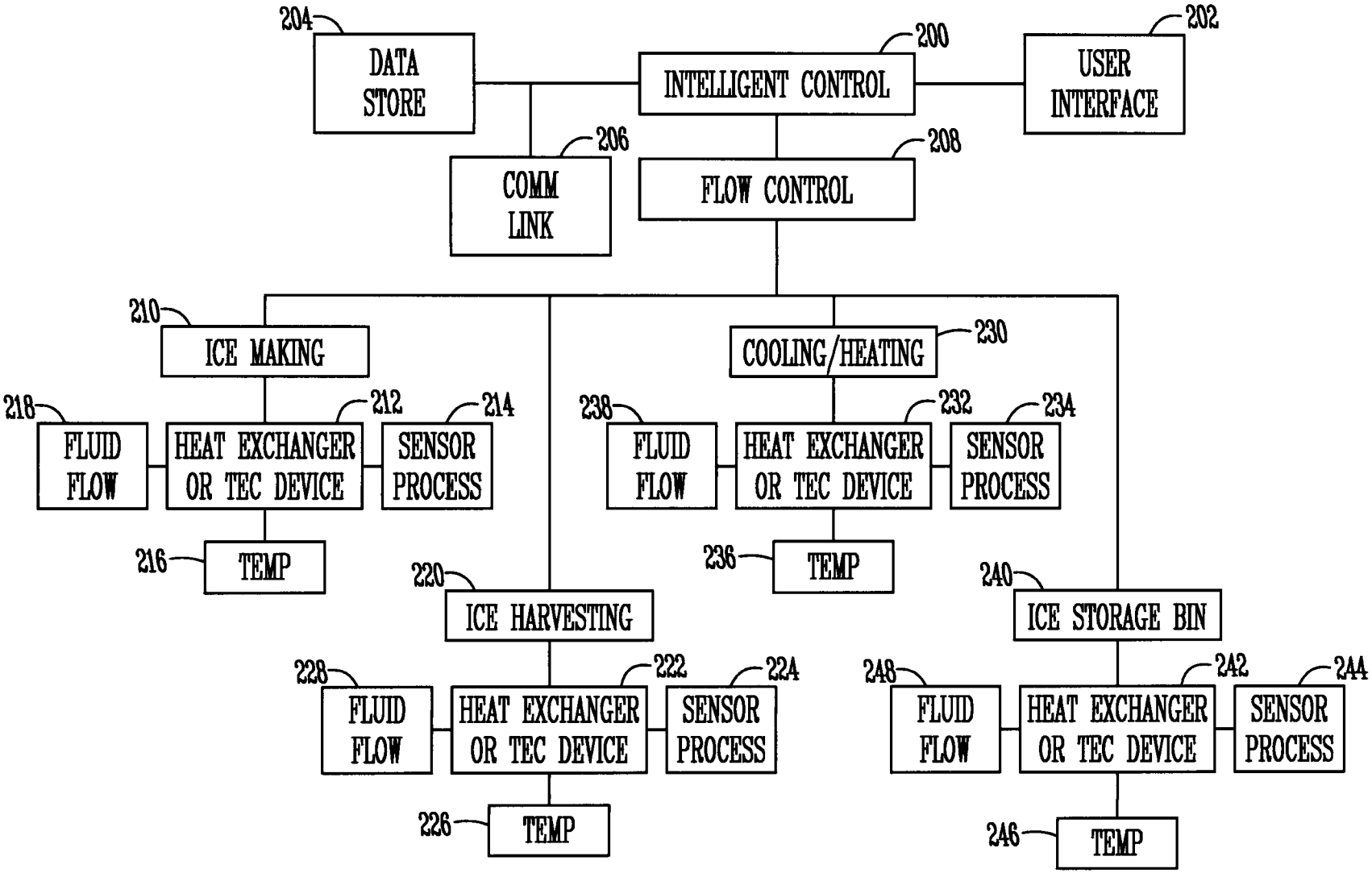
FIG. 11 is a flow diagram illustrating a process for intelligently controlling one or more operations of the exemplary configurations and embodiments of the refrigerator.

FIG. 11 provides a flow diagram illustrating control processes for exemplary aspects of the refrigerator. To perform one or more aforementioned operations or applications, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications of the refrigerator may be provided in operable communication with the intelligent control 200. A communications link 206 may be provided for exchanging information between the intelligent control 200 and one or more applications or processes of the refrigerator 10. The intelligent control 200 may also be used to control one or more flow controllers 208 for directing flow of a heat carrying medium such as air or fluid to the one or more applications or processes of the refrigerator 10. For example, in an ice making application 210, the flow controller 208 and intelligent control 200 may be configured to control and regulate fluid flow 218 between a thermoelectric (TEC) device process 212 at the ice making application 210 from a heater exchanger process 212 in the refrigerator compartment 14 or from a thermoelectric (TEC) device process 212 in the refrigerator compartment to a cooling application on the refrigerator compartment door 18 (e.g., ice mold 106 chilling, cooling application 124 or 86, ice storage bin 104 chilling, etc.). A sensor process 214 may be configured at a heat exchanger or TEC device 212 to monitor the temperature 226 or rate of the fluid flow 218 to the ice making application 210. In another aspect of the refrigerator 10, fluid flow 218 may also be controlled and regulated by the intelligent control 200 operating one or more flow controllers 208 for controlling fluid flow 218 from a heat exchanger or TEC device process 212 in the refrigerator compartment 14 onto the refrigerator compartment door 18 to a heat exchanger process 212 in thermal contact with the ice making application 210. In another application, fluid flow 218 from a heat exchanger process 212 within the refrigerator compartment 18 may be communicated to a thermoelectric (TEC) device process 212 on the refrigerator compartment door 18. Fluid flow 218 may also be controlled from the cabinet across to the door from a thermoelectric device process 212 in the refrigerator compartment 14 to a heat exchanger process 212 located on the refrigerator compartment door 18. The heat exchanger process 212 (e.g., fluid sink 100) may be configured in thermal contact with the ice making application 210 for extracting heat to make ice. The heat exchanger or TEC device process 212 in the refrigerator compartment 14 may be cooled or chilled by fluid flow 218 from the freezer compartment 16. For example, a fluid having the temperature 216 of the freezer compartment 16 may be communicated in a fluid flow 218 to a heat exchanger or TEC device process 212 in the refrigerator compartment 14 which is in turn communicated by fluid flow 218 from the refrigerator compartment 14 to the refrigerator compartment door 18 for facilitating the ice making application 210. One or more sensors for performing a sensor process 214 may be located at locations at or along the fluid flow 218 to determine the rate of fluid flow 218 or temperature 216 of fluid flow 218. Alternatively, the thermoelectric device process 212 may be positioned on the refrigerator compartment door 18. A fluid flow 218 communicates cold fluid or warm fluid by a fluid flow 218 to the ice making application 210. The intelligent control 200 may be configured to control one or more flow controllers 208 or sensor processes 214 for controlling the flow of fluid from the thermoelectric device process 212 to a heat exchanger 212 (e.g., fluid sink 100) in thermal contact with the ice making application 210 or other cooling/heating application for controlling the temperature 216 of the individual processes. For example, in one mode the thermoelectric device process 212 may be configured to communicate a warm temp 216 fluid flow 218 to a heat exchanger 212 in thermal contact with the ice making application 210. In another aspect, the (TEC) device process 212 may be configured to another mode to communicate chilled fluid flow 218 to a heat exchanger 212 in thermal contact with the ice making application 210. Alternatively, the (TEC) device process 212 may be configured to communicate a warm temp 216 fluid flow 218 from the (TEC) device process 212 to a heat exchanger 212 in thermal contact with the ice making application 210 or other warm temperature 216 applications. The intelligent control 200 may be configured to control the rate of delivery of fluid flow 218 by actuation of one or more flow controllers 208 communicating with one or more sensor processes 214. The temperature 216 of the fluid flow 218 to the heat exchanger 212 in thermal contact with the ice making application 210 may be controlled by operating or by controlling the (TEC) device process 212. Fluid flow 218 may be also communicated from the heat exchanger 212 in the refrigerator compartment 14 to the thermal electric device process 212 on the refrigerator compartment door 18. The rate of fluid flow 218 from the refrigerator compartment 14 to the refrigerator compartment door 18 (e.g., the ice making application) may be controlled by one or more flow controllers 208 under operation of the intelligent control 200 communicating with a sensor process 214. Thus, a sub-zero fluid exchange from the freezer compartment 16 to the refrigerator compartment 14 may be used to cool a heat exchanger 212 (e.g., fluid sink 100) in the refrigerator compartment 14. A sub-zero fluid exchange from the heat exchanger 212 in the refrigerator compartment may be configured to transfer sub-zero fluid from the refrigerator compartment 14 to a (TEC) device process 212 on the refrigerator compartment door 18. Fluid flow 218 may be communicated directly from the (TEC) device process 212 to the ice making application 210 or directly from the freezer compartment 16. Alternatively, a fluid flow 218 may be taken from the freezer compartment 16 to the refrigerator compartment 14 for cooling a (TEC) device process 212 in the refrigerator compartment 14. Temperature 216 of each process may be monitored with the sensor process 214. A fluid flow 218 may also be configured between the (TEC) device process 212 and the refrigerator compartment 14 to a heat exchanger 212 on the refrigerator compartment door 18 in thermal contact with the ice making application 210. In another aspect, a fluid loop from the freezer compartment may be configured for fluid flow 218 to a (TEC) device process 212 in the refrigerator compartment for providing fluid flow 218 from the refrigerator compartment 14 to the refrigerator compartment door 18 having the ice making application 210.

In another aspect of the invention, the intelligent control 200 operating one or more flow controllers 208 and monitoring one or more sensor processes 224 may be used for ice harvesting 220. For example, a (TEC) device process 222 may be configured in thermal contact with the ice harvesting application 220. Reversing the polarity of the (TEC) device process 222 may be used to warm the temperature 226 of the ice mold for facilitating ice harvesting application 220. In another aspect, a (TEC) device process 222 may be configured in the refrigerator compartment door 18 for communicating a warm temperature 226 fluid flow 228 to the ice harvesting application 220 for increasing the temperature 226 of the ice mold. Alternatively, a (TEC) device process 222 may be positioned within the refrigerator compartment 14. A fluid flow 228 exchange may be configured between the (TEC) device process 222 in the refrigerator compartment 14 and the ice harvesting application 220 on the refrigerator compartment door 18. Operating the (TEC) device process 222 in reverse polarity warms the fluid flow 228 communicated to the ice harvesting application 222. The temperature 226 of the ice mold is monitored by sensor process 224 and warmed to facilitate the ice harvesting application 220. An intelligent control 200 may be configured to control one or more flow controllers 208 for controlling the rate of fluid flow 228 from the (TEC) device process 222 to the ice harvesting application 220 on the refrigerator compartment door 18. The sensor process may be configured to communicate fluid flow 228 rates and temperature 226 of the fluid flow 228 and ice mold 106 during the ice harvesting application 220.

In another aspect of the invention, the intelligent control 200 may be configured to control one or more flow controllers 208 and one or more sensor processes 234 for supporting a cooling or heating application 230 on the refrigerator compartment door 18 or in the refrigerator compartment 14. For example, the heat exchanger or TEC device process 232 in the refrigerator compartment 14 may be configured to transfer a refrigerator compartment temperature 236 fluid flow 238 to a cooling application 230 on the refrigerator compartment door 18. The temperature 236 of the cooling or heating application 230 on the refrigerator compartment door 18 may be controlled by communicating fluid flow 238 from the refrigerator compartment 14 or from a heat exchanger TEC device process 232 in the refrigerator compartment 14. The temperature 236 of a fluid flow 238 may be detected by a sensor process 234 and communicated from a thermoelectric device process 232 connected in communication with a cooling and/or heating application 230 on the refrigerator compartment door 18 or in the refrigerator compartment 14. Fluid flow 238 from a (TEC) device process 232 may be used to cool or heat a cooling/heating application 230 on the refrigerator compartment door 18. For example, operating the (TEC) device process 232 in reverse polarity a warm temperature 236 fluid flow 238 may be monitored with sensor process 234 and communicated to a warming or heating application on the refrigerator compartment door 18. For example, water may be heated and monitored with sensor process 234 to provide a warm water supply to the dispenser 22 on the refrigerator 10. Warm water may also be heated and monitored with sensor process 234 to purge the ice making application 210. Alternatively, the (TEC) device process 232 may be configured to cool the temperature 236 of a fluid flow 238 for a cooling application 230. The intelligent control 200 may control one or more flow controllers 208 and sensor processes 234 for controlling the rate of flow of fluid flow 238 and temperature 238 to the cooling application 230. For example, the cooling application may be used to cool a reservoir of water for providing chilled water at the dispenser 22 of the refrigerator 10. Chilled water may also be communicated from the cooling application 230 to the ice making application 210 for providing pre-chilled water for making ice.

In another aspect of the invention, the intelligent control 200 may be used to control one or more flow controllers 208 and one or more sensor processes 244 for managing the temperature 246 of the ice storage bin 240. In one aspect, a warm or cool temperature 246 fluid flow 248 may be communicated from a (TEC) device process 242 to the ice storage bin application 240 for warming the ice storage bin 104 or chilling the ice storage bin 104. In the warming mode the temperature may be monitored with sensor process 234 so the ice in the ice bin is melted to provide a fresh ice product; in the cooling mode the ice in the ice bin is kept frozen also by monitoring the temperature 246 with sensor process 234. The (TEC) device process 242 may be operated to provide a warm temperature 246 fluid flow 248 to the ice storage bin 240. In reverse polarity the (TEC) device process 242 may be operated to provide a cool fluid flow 248 to the ice storage bin 240 for keeping the ice frozen. In another aspect of the refrigerator 10, the intelligent control 200 and one or more sensor processes 244 may be used to control the flow controller 208 for metering the fluid flow 248 from a heat exchanger process 242 in the refrigerator compartment 14 to the ice storage bin 240 in the refrigerator compartment door 18 for providing a fresh ice product. In another aspect, a sub-zero temperature 246 freezer compartment 16 fluid flow 248 may be used to cool a heat exchanger process 242 in the refrigerator compartment 14 which is in turn used to chill the ice storage bin 240 in the refrigerator compartment door 18. The chilled fluid flow 248 may be communicated from the refrigerator compartment 14 to the refrigerator compartment door 18 for chilling the ice storage bin 240. The cooling potential from the freezer compartment 16 may be communicated directly from the freezer compartment 16 to the refrigerator compartment door 18 for chilling the ice storage bin 240 or through the refrigerator compartment 14 via a heat exchanger or TEC device process 242. This sub-zero temperature 246 cooling potential from the freezer compartment may be communicated directly to the refrigerator compartment door 18 or through the refrigerator compartment 14 via a fluid flow 248 monitored with sensor process 234. In one aspect, fluid flow 248 from the freezer compartment 16 may be used to keep the ice storage bin 240 at a temperature 246 below freezing. In another aspect, fluid flow 248 to the ice storage bin 240 at a temperature 246 above freezing may be and monitored with sensor process 234 to provide a fresh ice product. Thus, one or more aspects for controlling the temperature of one or more applications and methods, such as for example, an ice making, ice harvesting, cooling/heating, and ice storage bin application on a refrigerator, are provided.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the exact location of the thermoelectric device, fluid supply and return pathways may be varied according to type of refrigerator used and desired performances for the refrigerator. In addition, the configuration for providing heating or cooling on a refrigerator compartment door using a thermoelectric device may be varied according to the type of refrigerator and the location of the one or more pathways supporting operation of the methods. It is understood that any other modifications, substitutions, and/or additions may be made, which are within the intended spirit and scope of the disclosure. From the foregoing, it can be seen that the exemplary aspects of the disclosure accomplishes at least all of the intended objectives.

What is claimed is:

1. A refrigerator with an in-door icemaker comprising:
- a freezer compartment;
- a fresh food compartment;
- a door for providing selective access to the fresh food compartment;
- an icemaker mounted on the door, the icemaker including an ice mold;
- a thermoelectric device comprising a first side and a second side disposed in the fresh food compartment;
- a first liquid refrigerant loop comprising a fluid supply pathway abutting and in thermal communication with the first side of the thermoelectric device and the ice mold;
- a second liquid refrigerant loop comprising a fluid supply pathway abutting and in thermal communication with the second side of the thermoelectric device and the freezer compartment;
- wherein the refrigerator further comprises an icemaking mode wherein the first side is a cold side and the second side is a warm side;
- wherein when the refrigerator is in the icemaking mode, heat is transferred from the ice mold to the first side via a first liquid circulating through the first liquid refrigerant loop, and heat is transferred from the second side to the freezer compartment via a second liquid circulating through the second liquid refrigerant fluid loop.

2. The refrigerator of claim 1, wherein the first liquid refrigerant loop further comprises a fluid return pathway in thermal communication between the icemaker and the cold side of the thermoelectric device when in the icemaking mode.

3. The refrigerator of claim 1, wherein the fluid supply pathway of the second liquid refrigerant loop is in thermal communication between the warm side of the thermoelectric device and the freezer compartment when in the icemaking mode.

4. The refrigerator of claim 1, wherein the second liquid refrigerant loop further comprises a heat exchanger within the freezer compartment and in thermal communication with the warm side of the thermoelectric device when in the icemaking mode.

5. The refrigerator of claim 1 further comprising:
- an insulated compartment on the door;
- an ice storage bin in the insulated compartment positioned to receive ice harvested from the ice mold; and
- wherein the fluid supply pathway of the first liquid refrigerant loop is in thermal communication with the insulated compartment and the cold side of the thermoelectric device when in the icemaking mode.

6. The refrigerator of claim 1, further comprising an ice harvesting mode.

7. The refrigerator of claim 6, wherein when in the ice harvesting mode the first side is a warm side and the second side is a cold side.

8. The refrigerator of claim 7, wherein when the refrigerator is in the ice harvesting mode, heat is transferred from the first side to the ice mold via the first liquid circulating through the first liquid refrigerant loop.

9. A refrigerator comprising:

a fresh food compartment;

a freezer compartment;

a door that provides access to the fresh food compartment;

an icemaker comprising an ice mold mounted on the door;

a first fluid loop in fluid communication with the icemaker;

a second fluid loop in fluid communication with the freezer compartment; and a thermoelectric device disposed in the fresh food compartment abuts and is in thermal communication with the first fluid loop and the second fluid loop such that in an icemaking mode heat is transferred from the ice mold to a first side of the thermoelectric device via the first fluid loop and from a second side of the thermoelectric device to the second fluid loop; and wherein heat is removed from the second fluid loop within the freezer compartment.

10. The refrigerator of claim 9, wherein the first fluid loop further comprises a liquid refrigerant supply pathway and a liquid refrigerant return pathway in communication between the icemaker and the first side of the thermoelectric device.

11. The refrigerator of claim 9, wherein the second fluid loop further comprises at least one flow pathway in communication between the fresh food compartment and the freezer compartment.

12. The refrigerator of claim 9 further comprising:

an insulated compartment on the door;

an ice storage bin in the insulated compartment positioned to receive ice harvested from the ice mold; and wherein the first fluid loop is in thermal communication with the insulated compartment and the first side of the thermoelectric device for chilling the insulated compartment when in the icemaking mode.

13. The refrigerator of claim 9, wherein the second fluid loop further comprises a liquid refrigerant supply pathway from the freezer compartment providing a thermal influence on the second side of the thermoelectric device when in the icemaking mode.

14. The refrigerator of claim 9, further comprising an ice harvesting mode.

15. The refrigerator of claim 14, wherein when in the ice harvesting mode the first side is a warm side and the second side is a cold side.

16. The refrigerator of claim 15, wherein when the refrigerator is in the ice harvesting mode, heat is transferred from the first side to the ice mold via a first liquid circulating through the first fluid loop.

* * * * *